US009574812B2

(12) United States Patent
Agostini

(10) Patent No.: US 9,574,812 B2
(45) Date of Patent: Feb. 21, 2017

(54) TECHNICAL GLACETTE

(75) Inventor: Massimo Agostini, Coseano (IT)

(73) Assignee: IDEA PROTOTIPI SRL, Basiliano (UD) (IT)

( * ) Notice: Subject to any disclaimer, the term of this patent is extended or adjusted under 35 U.S.C. 154(b) by 457 days.

(21) Appl. No.: 14/009,275

(22) PCT Filed: Mar. 27, 2012

(86) PCT No.: PCT/IB2012/000612

§ 371 (c)(1),
(2), (4) Date: Mar. 27, 2015

(87) PCT Pub. No.: WO2012/131470

PCT Pub. Date: Oct. 4, 2012

(65) Prior Publication Data

US 2015/0192342 A1 Jul. 9, 2015

(30) Foreign Application Priority Data

Apr. 1, 2011 (IT) ..... TV2011A0047

(51) Int. Cl.

| | |
|---|---|
| ***F25D 3/08*** | (2006.01) |
| ***F25D 11/00*** | (2006.01) |
| ***F25D 31/00*** | (2006.01) |
| ***A47G 23/02*** | (2006.01) |
| *F28D 20/02* | (2006.01) |

(52) U.S. Cl.

CPC ..... *F25D 11/003* (2013.01); *A47G 23/0241* (2013.01); *F25D 31/007* (2013.01); *F25D 2331/803* (2013.01); *F25D 2700/08* (2013.01); *F28D 20/02* (2013.01)

(58) Field of Classification Search

CPC ..... F25D 2331/803; F25D 2700/08; F25D 31/007; F25D 11/003; A47G 23/0241

See application file for complete search history.

(56) References Cited

U.S. PATENT DOCUMENTS

| | | | | |
|---|---|---|---|---|
| 3,365,911 A * | 1/1968 | Stoner | F25D 3/08 | 62/457.4 |
| 3,434,302 A * | 3/1969 | Stoner | F25D 3/00 | 165/46 |
| 4,344,113 A * | 8/1982 | Ditto | A47G 19/2227 | 362/101 |

(Continued)

*Primary Examiner* — Jianying Atkisson
*Assistant Examiner* — David Teitelbaum
(74) *Attorney, Agent, or Firm* — Egbert Law Offices, PLLC

(57) ABSTRACT

Technical glacette made of composite material, suitable for the refrigeration of a bottle containing beverages through a Phase Change Material injected into the cooling chamber of the glacette. The glacette is constituted by an outer casing that contains a removable refrigeration chamber to contain and refrigerate the bottle. The outer casing is open on one side or circumference to allow the reading of the label or bar code. The glacette is constituted also by a lower base integral to and united to the outer casing, which serves both as a base of support, and as light indication of the quantity of the beverage contained in the bottle. The lower base of the glacette also has a defined area which allows the 360° vision of the visual warning or change in color illumination when the beverage contained in the bottle varies due to the consumption of the beverage.

4 Claims, 2 Drawing Sheets

(56) References Cited

U.S. PATENT DOCUMENTS

| | | | | | |
|---|---|---|---|---|---|
| 4,528,439 | A * | 7/1985 | Marney, Jr. | A45C 11/20 | 165/902 |
| 4,531,381 | A * | 7/1985 | Toro | B65D 81/3834 | 62/372 |
| 4,809,522 | A * | 3/1989 | deNevers | B65D 81/3886 | 62/372 |
| 7,018,062 | B2 * | 3/2006 | Taylor | A47G 19/2227 | 362/101 |
| 2004/0007553 | A1 * | 1/2004 | Smolko | A41D 13/0053 | 215/12.1 |
| 2004/0114352 | A1 * | 6/2004 | Jensen | A47G 23/0309 | 362/101 |
| 2007/0053407 | A1 * | 3/2007 | Kinsler | G01K 1/14 | 374/208 |
| 2008/0056691 | A1 * | 3/2008 | Wingo | A01M 1/2033 | 392/395 |
| 2008/0195252 | A1 * | 8/2008 | Innocenti | B67D 1/0008 | 700/240 |
| 2008/0264955 | A1 * | 10/2008 | John | A47G 19/2227 | 220/629 |
| 2010/0157579 | A1 * | 6/2010 | Kononuk | A47G 23/0309 | 362/101 |

* cited by examiner

TECHNICAL GLACETTE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a technical glacette made of composite material, of the type suitable for the refrigeration of at least one bottle, for example in vertical condition, for beverages such as wine, water and other alcoholic beverages and non-alcoholic ones. In the present case the said technical glacette is of the type provided with a cavity, for example along the circumference of the blind opening housing of the bottle, so as to provide a containment chamber, inside which is contained some material, such as a PCM gel, which is able to refrigerate and/or maintain refrigerated the said bottle.

2. Description of Related Art Including Information Disclosed Under 37 CFR 1.97 and 37 CFR 1.98.

Nowadays crowding of restaurants and bars frequented by people of different ethnicities and ages, has become the main problem for the managers, who are having to offer a fast service combined with a quality that frequently suffers, due to the overcrowding of those establishments.

In particular, the area most afflicted of these establishments is the drinks one, as drinks are always the first request of a consumer who presents to a restaurant or to a bar.

Currently there is a consistent recourse to solutions in the field, sometimes original, but not exhaustive and economic for the purposes of quality of service, this because, in substance, yet do not set themselves the objective of recurring to the principles of automation and self-monitoring of drinks already in place, ordered by the various consumers of such establishments.

Known is in fact the storage using code readers of ordered item of beverages, in turn, ordered by consumers individually whereas the monitoring of the same is still a manual operation substantially a visual duty of the service staff or by express request from the consumers part.

Common can be thus complaints from the consumers part who find themselves often short of drinks or with beverages no more properly chilled, creating more so a continual movement of service personnel merely to satisfy said need.

A use fairly well known is that of glacette of the traditional type, which contain ice which melting acts as a release agent of the label usually affixed on the bottle of the drink as well as to constantly wet the bottle in which the beverage is contained, thus requiring a continuous drying of the bottle by means of a cloth which accompanies the glacette prior to its withdraw and use of the same, from the glacette.

What, therefore, we can say is that it's certainly known today, the overcrowding of public establishments such as restaurants and bars, which phenomenon and its effects directly and negatively impact on the management of rapidity, quality and quantity of the refrigeration of drinks served to consumers. What that thus results also known is the need to alleviate the burden of monitoring the management of beverages to the service personnel through a rapid automation, intelligently autonomous and of quality of such management. Known is undoubtedly lastly the disadvantage of the traditional glacette by immersion of the bottle in the ice, which are in fact rarely used nowadays and dispensed only in the case of high-cost drinks or in catering operations of high prestige.

State Of The Art

In the ambits of the devices, for cooling liquids such as wine, water and other alcoholic beverages and non-alcoholic ones, a search was conducted, which, although not extensive and not exhaustive, has made it possible to detect at least the following prior documents:

D1 EP1 51 2927 (A1)FUNKE OTMAR

D2 WO9,300,849 (A1) GROENLYKKE JEPPE ANDREAS

D3 U.S. Pat. No. 4,255,944 (A) GARDNER JAMES H

D4 WO9,522,273 (A1) ENTWISTLE RICHARD

D5 JP4,406,683 (B1) NAGAKURA YASUKUNI

D1 represents a carafe that contains a small amount of table wine at reduced temperature and the lower section is inserted in contact in cup-shaped cavity with a double wall that contains a heat retention gel between the walls, which is cooled and holds the temperature of wine during a meal.

D2 represents a lighted wine chiller. The chiller for wine is made of transparent material and is supported by a transparent support which serves as a light conductor for the light emitted by a lamp contained in a base element for the support column. The contents of the wine chiller are illuminated in such a way as to be observable and are presented with a particular aesthetic effect.

D3 represents a container for cooled wine and similar drinks or food that comprises a generally cylindrical casing in which a bottle or other container can be located. The casing is made of a heat conductor material, such as aluminum, copper, alloys of these, etc. . . . , of a thickness sufficient to conduct heat according to need in the direction of its length. The cooling device further comprises a receptacle of ice that keeps the ice or in contact with the casing or with an appendix or extension of the same. The casing acts so as to produce the container of wine with a surface that is level with or below the temperature of the wine. This substantially eliminates the transfer of heat by irradiation to the container of wine. The container also minimizes the convective and/or conductive heat transfer between the bottle of wine and the environment.

D4 Represents a container for one or more beverage bottle comprising an outer body and at least one removable spacer element. The container can be adapted to receive at least two bottles of wine simultaneously in the individual cavities, said cavities being separated by two of the spacer elements arranged back to back. The elements preferably include alveolar cells fillable with freezable liquid. At least one of the spacer elements is mobile in alternative positions to accommodate different sizes of bottles of wine. In the alternative positions, the spacer element forms with the container, alternative cavities of sizes and/or shapes substantially different.

D5 represents a cooling device of wine, which prevents the adhesion of water drops on a bottle of wine and allows the visual control of a label of a bottle of wine from a simple structure, since a conventional cooling device of wine generally requires the removal of water drops by cleaning the bottle with a towel because the water droplets adhere to the bottle of wine every time the bottle is taken out of the glacette to pour the wine into a glass. A removable fixing means applies a coolant on the inner wall of a container of cold storage, consisting of a cylindrical part and a part of the bottom surface or a container of cold storage made of bamboo cane. When the inside of the container of cold storage is filled with cold air of the cooler, the wine is maintained at an optimal temperature.

The fastening means may be a magnet, a surface fastener, a rib provided on the inner wall of the container, or other similar.

Ultimately it is reasonable to consider known:

a) a cup-shaped double wall cavity that contains a heat retention gel between the walls, which is cooled and holds the temperature of the wine during a meal;

b) an illuminated cooler for wine made of transparent material and supported by a transparent support which serves as a light conductor for the light emitted by a lamp contained in a base element for the support column. The contents of the wine cooler are illuminated in such a way as to be observable and are presented with a particular aesthetic effect;

c) a container for cooled wine and similar drinks or food that comprises a generally cylindrical casing in which a bottle or other container can be located. The casing is made of a material conductor of heat, such as aluminum, copper, alloys of these, etc., of a thickness sufficient to conduct heat according to need in the direction of its length;

d) a container for one or more beverage bottle comprising an outer body and at least one removable spacer element. The container can be adapted to receive at least two bottles of wine simultaneously in the individual cavities, said cavities being separated by two of the spacer elements arranged back to back. The elements preferably include alveolar cells fillable with freezable liquid.

e) a cooler of wine, which prevents the adhesion of water drops on a bottle of wine and allows visual inspection of a label on the bottle of wine from a simple structure;

Drawbacks

Having said all that, and from all of public domain, thus it should be noted that the means or wine coolers commonly used in the catering establishments are still using traditional materials such as ice or its substitutes such as gels or liquids contained in sealed traditional refrigeration chambers commonly said eutectic. These sealed eutectic chambers contain coolants which, however, suffer from a poor retention of the initial temperature refrigerant charge, which then tends to vary gradually but continuously, with a curve approximately linear up to reach room temperature.

As described it thus follows that is becoming consistent the recourse to solutions in the field, sometimes original, but not exhaustive and economic, this is because still do not arise nor the aim to use the most effective means of cooling such as PCM, nor the principles of automation and automonitoring of beverages already in place, ordered by the various consumers of said catering establishments.

However, as regards a solution of a specifically designed glacette containing a gel refrigerant of last generation, equipped with automation and self-monitoring of beverages distributed to the consumer, there are no realizations in both fields of patent prior art or in the public domain. All the known solutions, can also be found via a check in the web, in fact relate to the use of traditional static glacette, which basically utilize natural ice or gel conventional eutectics.

From all the above, there is a need for companies, particularly of the sector, to identify alternative solutions, most effective, compared to the solutions up to now in place. One purpose of the present invention is also to obviate the drawbacks described.

BRIEF SUMMARY OF THE INVENTION

This and other purposes are achieved with the present invention according to the characteristics of the included claims solving the mentioned problems through the development of a technical glacette made of composite material, suitable for the refrigeration of at least one bottle containing beverages such as wine, water and other alcoholic beverages and non-alcoholic ones through a PCM gel or Phase Change Material, injected into the cooling chamber of the same glacette, specially made to hold the bottle. The glacette in question is constituted by an outer casing that contains the removable refrigeration chamber apt to contain and refrigerate the bottle, which outer casing is open on one side or circumference to allow the reading of the label applied on the bottle or relative bar code. The glacette in question is constituted also by a lower base integral to and united to the outer casing, which serves both as a base of support, and as light indication of the quantity of the beverage contained in the bottle so contained and supported therein. The lower base of the glacette object of the present invention also has a defined area which allows the 360° vision of the visual warning or change in color illumination of the said when the beverage contained in the bottle varies due to the consumption of the beverage. The inner bottom of the glacette object of the present invention also contains devices and weighing means, temperature measurement, signaling visual, acoustic and radio, of the quantity and temperature of the beverage contained in the bottle contained and supported therein.

Purposes

In this way, through the considerable creative contribution whose effect has allowed to reach a considerable technical progress, are achieved some aims and benefits.

The first aim of the present invention was to enable the realization of a single glacette composite material device suitable for refrigeration for the refrigeration of—at least one bottle containing beverages such as wine, water and other alcoholic beverages and non-alcoholic ones by a gel PCM or Phase Change Material, injected into the refrigeration chamber of the same wine glacette, specifically designed to hold the bottle. This PCM gel has the characteristic of having a specific memory of temperature, which is retained, similarly to what happens for an electric battery, very constantly up to the reaching of the threshold of discharge of such material. Thus, it can be stated that the temperature of the beverage contained in the bottle will remain almost constant for the whole duration of the same, and in any case reasonably, for the duration of the individual catering.

A second aim was to build the glacette in question with an outer casing and a removable refrigeration chamber apt to contain and refrigerate the bottle, open on one side or circumference to allow the reading of the label on the bottle or relative bar code, without necessarily removing the bottle from the same wine glacette.

A third aim has been to provide the glacette in question of a lower base integral to and united to the outer casing, which serves both as a base of support, and as light indication of the quantity of the beverage contained in the bottle so contained and supported therein.

A fourth aim consists in the realization of the lower base of the glacette object of the present invention, which has an area that allows a 360° vision of the visual warning or color change of illumination, when the beverage contained in the bottle varies due to the consumption of the same.

A fifth aim was to provide in correspondence to the internal bottom of the glacette object of the present invention, devices and means of weighing, temperature sensing and visual signaling, acoustic and radio, referring to the quantity and temperature of the beverage contained in the bottle present in the glacette, so as to originate information usable by the user and also by the service personnel.

These and other advantages will appear from the following detailed description of preferred embodiments with the help of the attached schematic drawings, whose details of execution are not to be considered limitative but only illustrative.

DETAILED DESCRIPTION OF THE INVENTION

Figure 1:
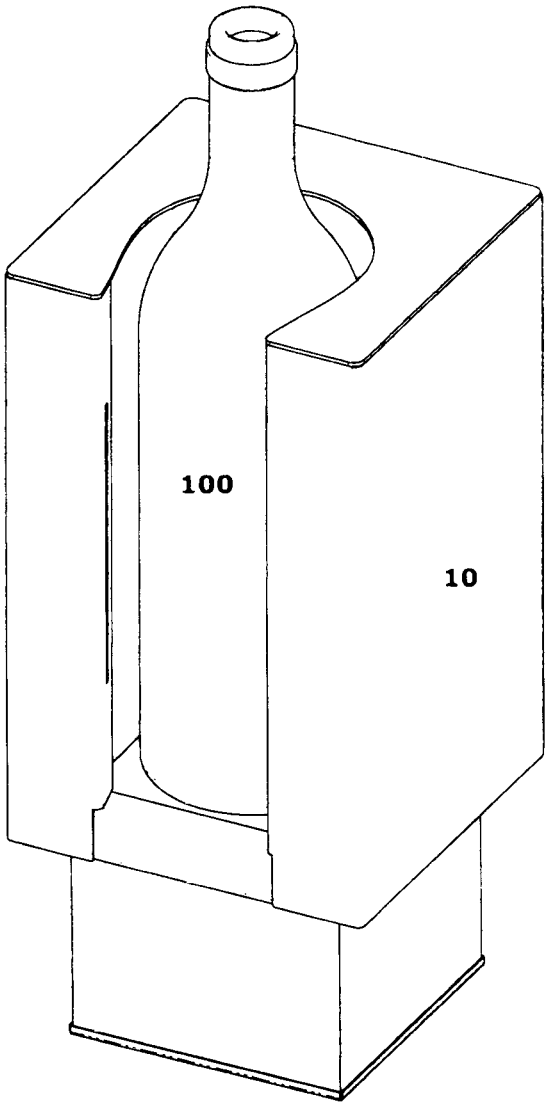
FIG. 1 is a three-dimensional view of the whole of the wine technical glacette, containing a bottle.
Figure 2:
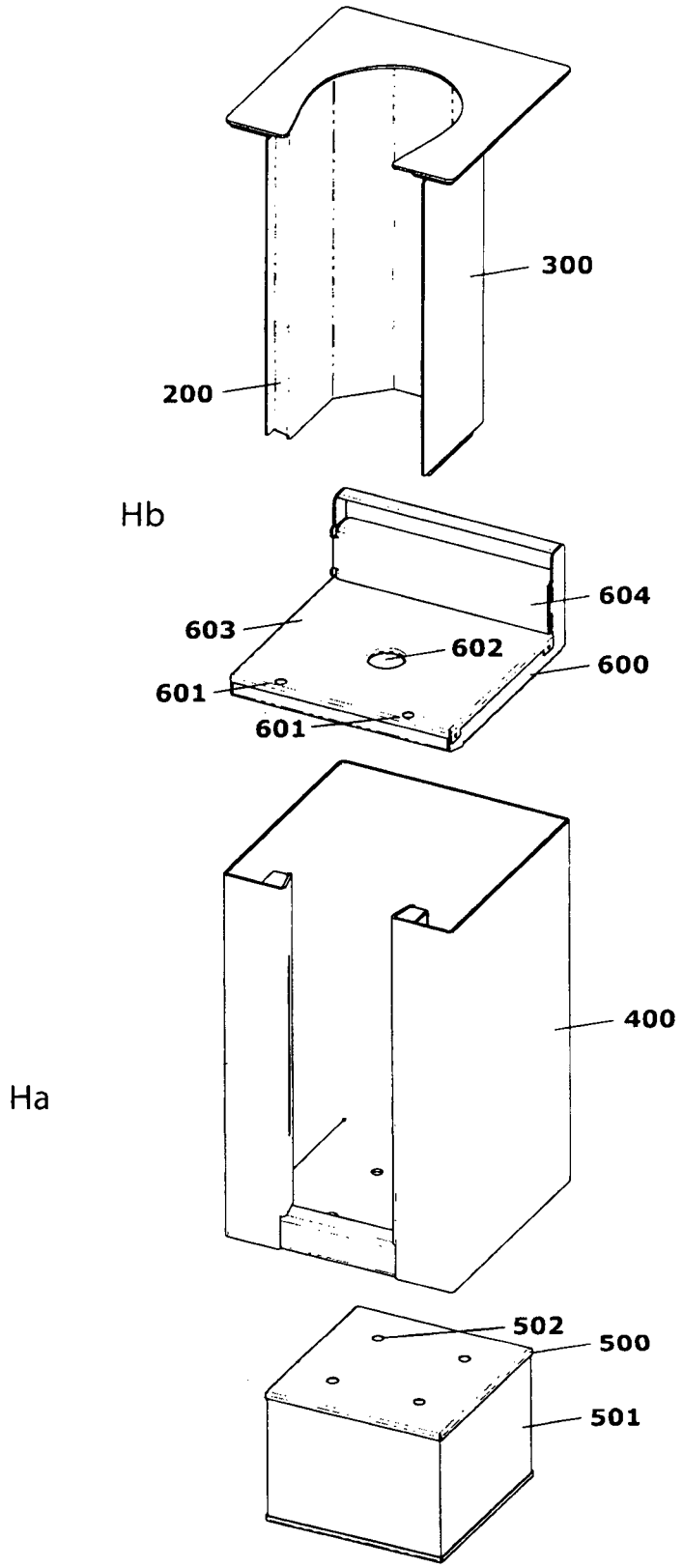
FIG. 2 is a three-dimensional exploded view of the technical glacette.

The object of the present invention relates to a technical glacette (10), provided with a containment body, so as to dispose of a housing substantially of cylindrical section, at least as deep as the development of the body excluding the bottle neck and shoulders, where said housing in the present case is vertical, which is limited at least in part by a vertical wall, with a bottom and from the opposite side of a mouthpiece. Said glacette (10) is of the type made of composite material, suitable for the refrigeration of at least one bottle (100) containing beverages such as wine, water and other alcoholic beverages and non-alcoholic ones, by means of a PCM gel (200) or Phase Change Material, injected into the refrigeration chamber (300) which is removable and made in various sizes, such as to accommodate any bottle (100) with introduction and housing in the outer casing (400) of the said glacette (10). More particularly, the outer casing (400) that has an aesthetic function, encloses and surrounds the refrigeration chamber (300) which is in one case, complementary formed to fit said outer casing (400).

Always the said technical glacette (10) made of composite material, suitable for the refrigeration of at least one bottle (100) containing drinks, is constituted by an outer casing (400) which is apt to contain and refrigerate the bottle (100), the which outer casing (400) is open longitudinally (Ha) as it is open longitudinally (Hb) the said refrigeration chamber (300) on one of the sides or circumference to allow the reading of the label on the bottle or relative bar code.

Again, the technical glacette (10) made of composite material, suitable for the refrigeration of at least one bottle (100) containing drinks, is also constituted by an integral lower base (500) and united with the outer casing (400), which serves as a support base, and as indication light (501) of the quantity of the beverage contained in the bottle (100) contained and supported therein.

In one case the said technical glacette (10) made of composite material, suitable for the refrigeration of at least one bottle (100) containing drinks, is also constituted by an inner bottom (600) integral to and united with the outer casing (400), which contains and integrates the devices and accessories means of weighing, of temperature sensing, of lighting device (601), of visual signaling (502), acoustic signaling (602) and radio device (603), of the quantity and temperature of the beverage contained into the bottle (100), contained and supported therein.

In a preferential solution the technical glacette (10) made of composite material, suitable for the refrigeration of at least one bottle (100) containing drinks, with the lower base (500) has an area of light indication (501) that allows a 360° vision of the visual signaling (502) or the color change by combination of passing LED light, lighting of the said, when the drink contained in the bottle (100) varies as a result of consumption.

Again in a preferential embodiment the technical glacette (10) made of composite material, suitable for the refrigeration of at least one bottle (100) containing beverages indicates, by means of the inner bottom (600), illuminating the above-mentioned area of light indication (501), through a visual signaling (502), when the level of the beverage is close to exhaustion. The same signal level of the beverage can be also transmitted by radio, by means of a digital signal that uses a protocol with low consumption, to the operator of the establishment, who may verify in real time the level of each bottle (100) dispensed.

The technical glacette (10) made of composite material, suitable for the refrigeration of at least one bottle (100) containing alcoholic and non-alcoholic drinks is provided with a lighting device (601) that originated at the bottom of the bottle powered by rechargeable batteries (604) lights for several hours, depending on the charge of said batteries (604) the bottle and its label.

Development of a technical glacette (10) made of composite material, suitable for the refrigeration of at least one bottle (100) containing beverages, which may be made of any geometric shape. The parallelepiped shape as it is represented in the drawings is purely exemplary but not exhaustive.

REFERENCES (10) Technical glacette assembly in three-dimensional perspective (FIG. 1) (100) bottle
(200) PCM gel
(300) removable refrigeration chamber
(400) outer casing
(500) lower base
(501) area of light indication
(502) visual signaling
(600) inner bottom
(601) lighting device
(602) acoustic signaling
(603) radio device
(604) rechargeable batteries.

The invention claimed is:

1. A glacette apparatus comprising:

an outer casing having a bottom and a plurality of side walls extending upwardly from said bottom in a generally rectangular configuration, one of said plurality of side walls having a longitudinal slot extending from said bottom to a top of the one of said plurality of side walls;

a refrigeration chamber removably positioned in an interior of said outer case, said refrigeration chamber having a phase change material in an interior of the refrigeration chamber, said refrigeration chamber having an inner wall defining an interior volume adapted to receive a bottle within the interior volume, said refrigeration chamber having a vertical slot opening to said interior volume, said vertical slot of said refrigeration chamber being aligned with said longitudinal slot of said outer case such that a portion of the bottle is exposed to an exterior of said outer casing;

an inner bottom structure positioned at said bottom of said outer casing, said inner bottom structure having an indicator light adapted to indicate a level of a liquid in the bottle, said inner bottom structure being integral with said outer casing, said inner device having a weight sensor, a temperature sensor, a light, an acoustic signal and a radio device therein so as to respond to a quantity and temperature of the liquid contained in the bottle; and a lower box affixed to said bottom of said outer casing, said lower box having an illumination device within the lower box so as to provide a 360° visual indication of consumption of liquid from the bottle.

2. The glacette apparatus of claim 1, the visual indication being a change of color by an LED.

3. The glacette apparatus of claim 1, further comprising:

a rechargeable battery electrically connected to said indicator light in said inner bottom structure.

4. The glacette apparatus of claim 1, said phase change material being a gel.

* * * * *